US005211838A

United States Patent [19]

Staubs, David W. et al.

[11] Patent Number: 5,211,838

[45] Date of Patent: May 18, 1993

[54] FIXED-BED/MOVING-BED TWO STAGE CATALYTIC REFORMING WITH INTERSTAGE AROMATICS REMOVAL

[75] Inventors: Staubs, David W., Morris Plains, N.J.; Stuart S. Goldstein, Ewell, England; Paul W. Kamienski, Basking Ridge; Gerrit S. Swart, Westfield, both of N.J.; George A. Swan, III, Baton Rouge, La.; Kenneth R. Clem, Humble, Tex.

[73] Assignee: Exxon Research & Engineering Company, Florham Park, N.J.

[21] Appl. No.: 805,334

[22] Filed: Dec. 9, 1991

[51] Int. Cl.[5] ..... C10G 35/04

[52] U.S. Cl. ..... 208/65; 208/63; 208/64

[58] Field of Search ..... 208/65

[56] References Cited

U.S. PATENT DOCUMENTS

| | | | |
|---|---|---|---|
| 3,640,818 | 2/1972 | Hamner | 208/65 |
| 3,748,255 | 7/1973 | Cassidy et al. | 208/65 |
| 3,748,256 | 7/1973 | Ko et al. | 208/65 |
| 3,748,259 | 7/1973 | Cassidy et al. | 208/65 |
| 3,864,240 | 2/1975 | Stone | 208/65 |
| 3,883,418 | 5/1975 | Drehmann | 208/65 |
| 3,992,465 | 11/1976 | Juguin et al. | 208/65 |
| 4,155,843 | 5/1979 | Gallagher | 208/65 |
| 4,167,473 | 9/1979 | Sikonia | 208/64 |
| 4,206,035 | 6/1980 | Hutson, Jr. et al. | 208/65 |
| 4,737,262 | 4/1980 | Franck et al. | 208/65 |
| 4,808,457 | 2/1989 | Ngan | 208/65 |
| 4,832,821 | 5/1989 | Swan, III | 208/654 |
| 4,872,967 | 10/1989 | Clem et al. | 208/65 |
| 4,975,178 | 12/1990 | Chen et al. | 208/65 |
| 4,985,132 | 1/1991 | Moser et al. | 208/65 |
| 4,992,158 | 2/1991 | Schweizer | 208/65 |

*Primary Examiner*—Helane Myers
*Attorney, Agent, or Firm*—Henry E. Naylor

[57] ABSTRACT

A two stage process for catalytically reforming a gasoline boiling range hydrocarbonaceous feedstock. The reforming is conducted in two stages wherein the first stage is operated in a fixed bed mode, and the second stage is operated in a moving bed continual catalyst regeneration mode. A gaseous stream comprised of hydrogen and predominantly $C_4^-$ and a $C_5^+$ liquid stream are produced between stages. A portion of the hydrogen-rich stream is recycled and the and the remaining portion and an aromatics-lean stream, which is obtained during aromatics separation between stages, is sent to second stage reforming.

9 Claims, 1 Drawing Sheet

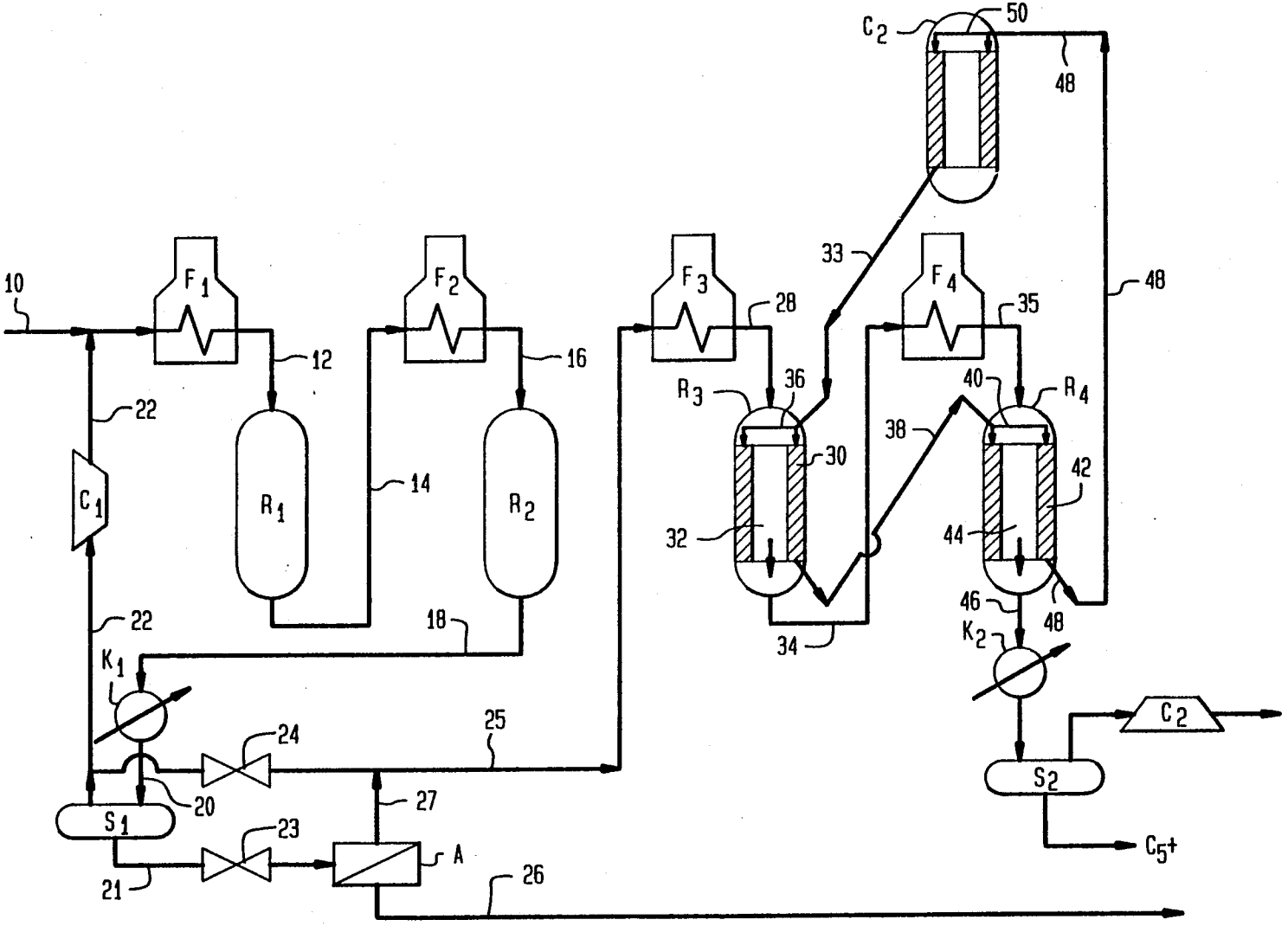
10
12
14
16
18
20
21
22
23
24
25
26
27
28
30
32
33
34
35
36
38
40
42
44
46
48
50
F1
F2
F3
F4
R1
R2
R3
R4
C1
C2
K1
K2
S1
S2
A
C5+

FIXED-BED/MOVING-BED TWO STAGE CATALYTIC REFORMING WITH INTERSTAGE AROMATICS REMOVAL

FIELD OF THE INVENTION

The present invention relates to a two stage process for catalytically reforming a gasoline boiling range hydrocarbonaceous feedstock. The reforming is conducted in two stages wherein the first stage is operated in a fixed-bed mode, and the second stage is operated in a moving bed continual catalyst regeneration mode. An aromatics-rich stream is separated and collected between stages and the remaining aromatics-lean stream is sent to second stage reforming.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst descends the reactor in an annular bed and is passed to a regeneration zone and after regeneration it is recycled to the moving-bed reactor. Both the reactor and the regenerator are operated in a continuous moving-bed mode.

With the gradual phasing out of lead from the gasoline pool and with the introduction of premium grade lead-free gasoline in Europe and the United States, petroleum refiners must re-evaluate how certain refinery units are run to meet this changing demand for higher octane fuels with the use of lead. Because catalytic reforming units produce product streams which represent the heart of the gasoline pool, demands are being put on these units for generating streams with ever higher octane ratings.

Multistage reforming process schemes have been developed wherein the reactant stream is partially reformed at relatively low severity in a first stage. The partially reformed stream undergoes a separation between stages to remove the heavier aromatic components before they can be passed to a low pressure stage. This is because reforming reactors operated in semiregenerative and cyclic modes cannot operate with a full range first stage product stream at low pressure and low hydrogen/oil ratio typified by such processes. A full range product stream at such conditions would cause too much carbon, or coke, to deposit on the catalyst, thus leading to rapid catalyst deactivation.

U.S. Patents which teach such a process scenario are U.S. Pat. Nos. 4,872,967 and 4,975,178, which are incorporated herein by reference, and which teach a multistage process for semiregenerative and cyclic reforming wherein an aromatics-rich stream is separated from an aromatics-lean stream between stages. The aromatics-rich stream, which is high in octane, is collected for mogas blending stock and the aromatics-lean stream is passed for additional reforming in the next downstream stage, which is typically operated at higher severity, or lower pressures, than the upstream stage. This results in increased yields and hydrogen production over more conventional reforming processes, such as single stage semi-regenerative and cyclic processes.

While these two patents teach the aromatics-lean stream going to additional reforming, it is also taught in copending application U.S. Ser. No. 747,894; filed Aug. 19, 1991. that there can be a benefit gained if, after heavier aromatics separation between stages, the stream, which is passed to the next downstream stage for additional reforming, contains a substantial amount of lighter aromatics. The stream passed to the next downstream stage in that application is a stream comprised of $C_8$ and lower carbon number aromatics, as well as uncoverted paraffins. $C_9+$ aromatics are removed by distillation.

Also, U.S. Pat. No. 3,992,465 teaches a two stage reforming process wherein the first stage is comprised of at least one fixed-bed reforming zone and the second stage is comprised of a moving-bed reforming zone. The teaching of U.S. Pat. No. 3,992,465 is primarily to subject the reformate, after second stage reforming to a series of fractionations and an extractive distillation of the $C_6$–$C_7$ cut to obtain an aromatic-rich stream.

While such teachings are a step in the right direction, there still remains a need in the art for improved reforming processes which can overcome such disadvantages. There is also a need in the art for the modification of conventional fixed-bed reforming process units to incorporate some of the advantages of moving-bed reforming units, without having to build an entirely new grass-roots moving-bed unit.

SUMMARY OF THE INVENTION

In accordance with the present invention, there is provided a process for catalytically reforming a gasoline boiling range hydrocarbon reactant stream in the presence of hydrogen in a reforming process unit comprised of a plurality of serially connected reforming zones wherein each of the reforming zones contains a reforming catalyst comprised of one or more Group VIII noble metals on a refractory support. The catalyst may be either monofunctional or bifunctional. The process comprises:

(a) conducting the reforming in two stages wherein the first stage is comprised of one or more reforming zones each of which is operated in a fixed-bed mode and wherein the second stage is comprised of one or more reforming zones each of which is operated in a moving-bed mode;

(b) separating aromatics from at least a portion of the reaction stream between stages to produce an aromatics-rich stream and an aromatics-leans stream;

(c) passing at least a portion of the aromatics-lean stream to the second reforming stage; and (d) conducting the reforming of the second stage in a moving-bed continual catalyst regeneration mode wherein the catalyst descends through the reforming zone, exits, and is passed to a regeneration zone where at least a portion of the accumulated carbon is burned-off, and where the regenerated catalyst is recycled to the reforming zone, said catalyst comprised of one or more Group VIII noble metals on substantially spherical refractory support particles and wherein the second stage reforming is conducted at a pressure of at least about 25 psig lower than the first stage.

In a preferred embodiment of the present invention, the aromatics are separated by a technique selected from extraction, extractive distillation, distillation, adsorption, by flashing, or by use of a semipermeable membrane.

In other preferred embodiments of the present invention, a $C_6$ heartcut fraction is taken from the reaction stream prior to feeding it into the first stage reforming and is sent directly to the second stage.

In still another preferred embodiment of the present invention: (i) a $C_6$ heartcut fraction is taken from the reaction feed stream prior to feeding it into the first reforming stage, which heartcut fraction is sent directly to the second reforming stage; and (ii) a separation is performed between the stages which produces a $C_9+$ aromatics-rich stream which is collected, a $C_5-$ fraction which is collected, and the remaining aromatics-lean fraction which is sent to second stage reforming.

In yet other preferred embodiments of the present invention, a $C_6$-heartcut fraction is not taken from the feedstock, but a separation is performed between the stages which produces a $C_9+$ aromatics-rich stream which is collected, a $C_5-$ fraction which is collected, and the remaining aromatics-lean fraction which is sent to second stage reforming.

In another preferred embodiment of the present invention, from about 50 to 85 vol. % of the hydrogen-rich gas separated between stages is recycled to the first stage.

In still another preferred embodiment of the present invention, the catalyst of the second stage is comprised of platinum and tin on alumina particles which are substantially sperical in shape.

In another preferred embodiment of the present invention, the process is a two stage process wherein gaseous products from the first stage are cascaded through the reforming zones in once-through mode to the second stage.

BRIEF DESCRIPTION OF THE FIGURE

The sole FIGURE hereof depicts a simplified flow diagram of a preferred reforming process of the present invention. The reforming process unit is comprised of a first stage which includes a lead reforming zone, which is represented by a lead fixed-bed reactor $R_1$, and a first downstream reforming zone, which is represented by another fixed-bed reactor $R_2$, which first stage is operated in semi-regenerative mode, although it may also be designed to operate in a cyclic mode. There is also a second stage which contains two serially connected reforming zones in fluid communication with a regenerative zone, which reforming zones are represented by annular radial flow reactors wherein the catalyst continually descends through the reactors and is transported to the regeneration zone, then back to the reactors, etc. An aromatics-rich and aromatics-lean stream are generated between stages with the aromatics-lean stream being passed to the second reforming stage.

DETAILED DESCRIPTION OF THE INVENTION

Feedstocks, also sometimes referred to herein as reactant streams, which are suitable for reforming in accordance with the instant invention, are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphthas, synthetically produced naphthas such as coal and oil-shale derived naphthas, thermally or catalytically cracked naphthas, hydrocracked naphthas, or blends or fractions thereof.

Referring to the sole FIGURE hereof, a gasoline boiling range hydrocarbon reactant stream, which is preferably first hydrotreated by any conventional hydrotreating method to remove undesirable components such as sulfur and nitrogen, is passed to a first reforming stage represented by heater, or preheat furnaces $F_1$ and $F_2$, and reactors $R_1$ and $R_2$. A reforming stage, as used herein, is any one or more reforming zones, in this figure reactors, and its associated equipment (e.g., preheat furnaces etc.). The reactant stream is fed into heater, or preheat furnace, $F_1$, via line 10 where it is heated to an effective reforming temperature. That is, to a temperature high enough to initiate and maintain dehydrogenation reactions, but not so high as to cause excessive hydrocracking. Because reforming reactions are typically endothermic, the reactant stream must be reheated to reforming temperatures between reforming zones. The heated reactant stream is then fed, via line 12, into reforming zone $R_1$ which contains a catalyst suitable for reforming. Such a catalyst typically contains at least one Group VIII noble metal with or without a promoter metal, on a refractory support. Reforming zone $R_1$, as well as all the other reforming zones in this first stage, are operated at reforming conditions. Typical reforming operating conditions for the reactors of this first fixed-bed stage include temperatures from about 800° to about 1200° F.; pressures from about 100 psig to about 500 psig, preferably from about 150 psig to about 300 psig: a weight hourly space velocity (WHSV) of about 0.5 to about 20, preferably from about 0.75 to about 5 and a hydrogen to oil ratio of about 1 to 10 moles of hydrogen per mole of $C_5+$ feed, preferably 1.5 to 5 moles of hydrogen per mole of $C_5+$ feed.

The effluent stream from reforming zone $R_1$ is fed to preheat furnace $F_2$ via line 14, then to reforming zone $R_2$ via line 16. The effluent stream from this first stage is sent to cooling zone $K_1$ via line 18 where it is cooled to condense a liquid phase to a temperature within the operating range of the recycle gas separation zone, which is represented in the FIGURE hereof by separation drum $S_1$. The temperature will generally range from about 60° to about 300° F., preferably from about 80° to 125° F. The cooled effluent stream is then fed to separation zone $S_1$ via line 20 where a hydrogen-rich gaseous stream, typically being predominantly a $C_4-$ gaseous stream, and a heavier liquid stream, which is typically a $C_5+$ stream, are produced. It is understood that these streams are not pure streams. For example, the separation zone will not provide complete separation between the $C_4-$ components and the $C_5+$ liquids. Thus, the gaseous stream will contain minor amounts of $C_5+$ components and the liquid stream will contain minor amounts of $C_4-$ components and hydrogen.

A portion of the hydrogen-rich gaseous stream is recycled, via line 22, to line 10 by first passing it through compressor $C_1$ to increase its pressure to feedstock pressure. About 40 to 90 vol. %, preferably about 50 to 85 vol. %, of the hydrogen-rich gaseous stream will be recycled. Of course, during start-up, the unit is pressured-up with hydrogen from an independent source until enough hydrogen can be generated in the first stage for recycle. It is preferred that the first stage be operated in semi-regenerative mode, although a cyclic mode can also be used.

The remaining portion of the hydrogen-rich gaseous stream from separation zone $S_1$ is passed to the second reforming stage via pressure control valve 24 where pressure is reduced to the level required for second stage operation. The amount of pressure reduction will depend on the operating pressure of the second stage separation zone $S_2$ and the pressure drop in furnaces $F_3$ and $F_4$, reactors $R_3$ and $R_4$, and the connecting piping. The heavier liquid fraction passes from separation zone $S_1$ through a level control valve, not shown, and is passed via line 21, through pressure reduction valve 23, to aromatics separation unit A where aromatic materials are separated in one or more steps to produce an aromatics-rich stream, an aromatics-lean stream, and optionally and not shown in the FIGURE hereof, a stream containing predominantly $C_5$ and lighter hydrocarbons which comprise a portion of the aromatics-lean stream. This optional stream might be required to effect an economical separation of the remaining $C_6+$ product can be removed as product or may be mixed back with the aromatics-rich stream for processing in the second stage. The terms "aromatics-rich" and "aromatics-lean" as used herein refer to the level of aromatics in the liquid fraction reaction stream after aromatic separation relative to the level of aromatics prior to separation. That is, after a reaction stream is subjected to an aromatics separation, two fractions result. One fraction has a higher level of aromatics relative to the stream before separation and is thus referred to as the aromatics-rich fraction. The other fraction is, of course, the aromatics-lean fraction which can also be referred to as the paraffin-rich fraction. Aromatics separation can be accomplished by any suitable method. Non-limiting methods suitable for use herein for aromatics separation include: extraction, extractive distillation, distillation, flashing, adsorption, and by permeation through a semipermeable membrane, or by any other appropriate aromatics or paraffins removal process. Preferred are extractive distillation, distillation, and flashing.

Both the aromatics-rich and the aromatics-lean streams will also contain paraffinic and naphthenic material. The aromatics-rich stream, because of the relatively high level of aromatic components, has a relatively high octane value. Such a high octane stream, which exits the aromatics separation unit via line 26, can be used as a high octane blending stock, or it can be used as a source of raw material for chemical feedstocks. The aromatics-lean fraction exits the aromatics separation unit via line 27 where it is mixed with the hydrogen-rich gaseous stream from the first stage via line 25, which passes from the separation zone $S_1$ through pressure reduction valve 24, then to second stage reforming by passing through furnace $F_3$ via line 29 where it is heated to reforming temperatures. Any $C_5-$ and lighter hydrocarbons which were removed in aromatics separation unit A, would be mixed with aromatic-lean stream before furnace $F_3$.

The heated aromatics-lean stream from furnace $F_3$ is passed to reforming zone $R_3$ via line 28, which is operated in a continuous moving-bed mode. Such reforming zones, or reactors, are well known in the art and are typical of those taught in U.S. Pat. Nos. 3,652,231; 3,856,662; 4,167,473; and 3,992,465 which are all incorporated herein by reference. The general principle of operation of such reforming zones is that the catalyst is contained in an annular bed formed by spaced cylindrical screens within the reactor. The reactant stream is processed through the catalyst bed, typically in an out-to-in radial flow, that is, it enters the reactor at the top and flows radially from the reactor wall through the annular bed of catalyst 30 which is descending through the reactor, and passes into the cylindrical space 32 created by said annular bed. It exits the bottom of the reforming zone and is passed, via line 34, to furnace $F_4$, then to reforming zone $R_4$ via line 35. Again, as in reforming zone $R_3$, the reactant stream passes out-to-in radially through the catalyst bed and into the cylindrical space 44, defined by said annular bed of catalyst. The effluent stream from reforming zone $R_4$ is passed via line 46 to cooling zone $K_2$ where the temperature of the stream is dropped to about 60° to 300° F., preferably from about 80° to 125° F. It is then passed into separation zone $S_2$ via line 50 where it is separated into a light hydrogen-rich $C_4-$ gaseous stream and a $C_5+$ liquid stream. The $C_5+$ stream is collected for blending in the gasoline pool via line 52 and the gaseous stream is collected as a product gas, but by first passing it through compressor $C_2$ via line 54. The product gas can be stored for further use or sale, or it can be passed on for further processing.

Fresh or regenerated catalyst is charged to reforming zone $R_3$ by way of line 33 and distributed in the annular moving bed 30 by means of catalyst transfer conduits 36, the catalyst being processed downwardly as an annular dense-phase moving bed. The reforming catalyst charged to reforming zones $R_3$ and $R_4$ is comprised of at least one Group VIII noble metal, preferably platinum; and one or more promoter metals, preferably tin, on spherical particles of a refractory support, preferably alumina. The spherical particles have an average diameter of about 1 to 3 mm, preferably about 1.5 to 2 mm, the bulk density of this solid being from about 0.5 to 0.9 and more particularly from about 0.5 to 0.8. The annular moving bed of catalyst exits from the bottom section of reforming zone $R_3$ and is passed via line 38 to reforming zone $R_4$ where it is distributed into the annular moving catalyst bed 42 by transfer from conduits 40. Reforming conditions for the moving bed reforming zones will include temperatures from about 800° to 1200° F., preferably from about 800° to 1000° F.; pressures from about 30 to 300, preferably from about 50 to 150 psig; a weight hourly space velocity from about 0.5 to 20, preferably from about 0.75 to 6. Hydrogen-rich gas should be provided to maintain the hydrogen to oil ratio between the range of about 0.5 to 5, preferably from about 0.75 to 3. In the preferred embodiment, all of the hydrogen gas is supplied by the hydrogen-rich predominantly $C_4^-$ gaseous stream which passes through pressure control valve 24. Instances may exist in which the gas flowing from the first stage is insufficient to supply the needed hydrogen to oil ratio. This could occur if the feedstock to the first stage was highly paraffinic or had a boiling range which included predominantly hydrocarbons in the 6 to 8 carbon number range. In these instances, hydrogen would need to be supplied from external sources such as a second reforming unit or a hydrogen plant. An additional, but less preferred source of hydrogen would be from compressing and recycling stream 54. This option would require additional compressor or a larger capacity compressor $C_2$.

The catalyst of reforming zone $R_4$ descends through the zone where it exits and is passed to catalyst regeneration zone CR via line 48 and transfer conduit 50 where the catalyst is subjected to one or more steps common to the practice of reforming catalyst regeneration. The catalyst regeneration zone CR represents all of the steps required to remove at least a portion of the carbon from the catalyst and return it to the state needed for the reforming reactions occurring in reforming zone $R_3$. The specific steps included in CR will vary with the selected catalyst. The only required step is one where accumulated carbon is burned-off at temperatures from about 600° to 1200° F. and in the presence of an oxygen-containing gas, preferably air. Additional steps which may also be contained in the catalyst regeneration equipment represented by CR include, but are not limited to, adding a halide to the catalyst, purging carbon oxides, redispersing metals, and adding sulfur or other compounds to lower the rate of cracking when the catalyst first enters the reforming zone.

The regenerated catalyst is then charged to reforming zone $R_3$ via line 33 and the cycle of continuous catalyst regeneration is continued until the entire reforming unit (both stages) is shut down, such as for catalyst regeneration of first stage (fixed-bed) reforming, which, if operated in a semi-regenerative mode would need to be regenerated from time to time by shutting off the feed and raising the reactors to regeneration temperatures in the presence of an oxygen-containing gas. It is to be understood that the catalyst in the moving-bed reforming and regeneration zones may not be constantly moving, but may only move intermittently through the system. This may be caused by the opening an closing of various valves in the system. Thus, the word "continuous" is not to be taken literally and the word "continual" is sometimes used interchangeably with "continuous".

The moving-bed zones of the second stage may be arranged in series, side-by-side, each of them containing a reforming catalyst bed slowly flowing downwardly, as mentioned above, either the regenerated catalyst is then charged to reforming zone $R_3$ continuously or, more generally, periodically, said bed forming an uninterrupted column of catalyst particles. The moving bed zones may also be vertically stacked in a single reactor, one above the other, so as to ensure the downward flow of catalyst by gravity from the upper zone to the next below. The reactor then consists of reaction zones of relatively large sections through which the reactant stream, which is in a gaseous state, flows from the periphery of the interior of the reactor (although a reactor can be designed to have the reactant stream flow from the center to the periphery) interconnected by catalyst zones of relatively small sections, the reactant stream issuing from one catalyst zone of large section divided into a first portion (preferably from 1 to 10%) passing through a reaction zone of small section for feeding the subsequent reaction zone of large section and a second portion (preferably from 99 to 90%) sent to a thermal exchange zone and admixed again to the first portion of the reactant stream at the inlet of the subsequent catalyst zone of large section.

When using one or more reaction zones with a moving-bed of catalyst, said zones as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift" (not shown in the FIGURE hereof). The fluid of the lift used for conveying the catalyst may be any convenient gas, for example nitrogen or still for example hydrogen and more particularly purified hydrogen or recycle hydrogen.

Catalysts suitable for use in any of the reactors of any of the stages include both monofunctional and bifunctional, monometallic and multimetallic noble metal-containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the second stage reforming must be in the form of substantially spherical particles as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.1 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

It is also within the scope of the present invention that the catalyst used in the fixed-bed reforming zones may include crystalline aluminosilicates, such as zeolites. Non-limiting examples of zeolites which may be used herein include those having an effective pore diameter, particularly L-zeolites, zeolite X, and zeolite Y. Preferred are the L-type zeolites, which can be defined as synthetic zeolites which crystallize in the hexagonal system with a characteristic X-ray diffraction pattern obtained from CuK $\alpha$ radiation, and values as set forth in column 8 of U.S. Pat. No. 4,975,178, which is incorporated herein by reference.

It is within the scope of the present invention that the aromatics separation be conducted to produce three streams instead of two. One stream would be a $C_5-$ gaseous stream which can be collected overhead. A second stream would be a $C_9+$ aromatics-rich stream which would be collected for blending in the mogas pool. A third stream would be that which is remaining from the effluent stream which would then be sent to second stage reforming.

It is within the scope of the present invention that a $C_6$ heartcut fraction be taken from the reaction stream feedstock prior to introduction into furnace $F_1$ and sent directly to second stage reforming.

By practice of the present invention, reforming is conducted more efficiently and results in increased hydrogen and $C_5+$ liquid yields. The first stage reactors are operated at conventional reforming temperatures and pressures in semiregenerative or cyclic mode while the reactors of the second stage are moving bed reactors operated substantially at lower pressures. Such pressures in the second stage may be from as low as about 30 psig to about 100 psig. More particularly, the downstream reactors can be operated in once-through gas mode because there is an adequate amount of hydrogen generated, that when combined with the hydrogen-rich gas stream from the first stage, is an adequate amount of hydrogen to sustain the reforming reactions taking place.

The downstream reactors, operating in the once-through hydrogen-rich gas mode, permit a smaller product-gas compressor ($C_2$ in the FIGURE) to be substituted for a larger capacity recycle gas compressor. Pressure drop in the second stage is also reduced by virtue of once-through gas operation.

Various changes and/or modifications, such as will present themselves to those familiar with the art may be made in the method and apparatus described herein without departing from the spirit of this invention whose scope is commensurate with the following claims.

We claim:

1. A process for catalytically reforming a gasoline boiling range hydrocarbon reactant stream in the presence of hydrogen in a reforming process unit comprised of a plurality of serially connected reforming zones, wherein each of the reforming zones contains a reforming catalyst comprised of at least one Group VIII noble metal on a refractory support, which process comprises:

(a) conducting the reforming in two stages wherein the first stage is comprised on one or more reforming zones, each of which is operated in a fixed-bed mode, and wherein the second stage is comprised of one or more reforming zones each of which is operated in a moving-bed mode;

(b) separating three stream between reforming stages, (i) a $C_9+$ aroatics-rich stream, (ii) a $C_5-$ stream, and (iii) a remaining fraction, wherein the separation of said aromatics is accomplished by a technique selected from the group consisting of extractive distillation, distiallation, and flashing;

(c) passing at least a portion of said remaining fraction to the second reforming stage and collecting the $C_9+$ aromatics-rich stream and the $C_5-$ stream; and (d) conducting the reforming of the second stage in a moving-bed continuous catalyst regeneration mode wherein the catalyst descends through the reforming zone, exits, and is passed to a regeneration zone where at least a portion of the accumulated carbon is burned-off, and where the regenerated catalyst is recycled to the reforming zones of said second reforming stage, said catalyst comprised of at least one Group VIII noble metal on a substantially sperical refractory support, and wherein the second stage reforming is conducted at a pressure of at least about 25 psig lower than the first stage.

2. The process of claim 1 wherein the catalyst of the second reforming stage is comprised of about 0.01 to 5 wt. % platinum, 0.01 to 5 wt. % tin, on substantially spherical particles of a refractory support.

3. The process of claim 1 wherein the amount of platinum and tin are each from about 0.1 to 2 wt. % and the spherical refractory support particles are comprised of alumina.

4. The process of claim 1 wherein the catalyst in each of the first stage reforming zones is comprised of about 0.01 to 5 wt. % platinum, and about 0.01 to 5 wt. % of at least one metal selected from the group consisting of iridium, rhenium, and tin.

5. The process of claim 3 wherein the catalyst in each of the first stage reforming zones is comprised of about 0.01 to 5 wt. % platinum, and about 0.01 to 5 wt. % of at least one metal selected from the group consisting of iridium, rhenium, and tin.

6. The process of claim wherein the aromatics separation between stages is accomplished by a technique selected from extractive distillation, distillation, and flashing.

7. The process of claim 5 wherein the aromatics separation between stages is accomplished by a technique selected from extractive distillation, distillation, and flashing

8. The process of claim wherein a $C_6$ heartcut is separated from the feedstock before it enters a reforming zone and is directed to the lead reactor of the second reforming stage.

9. The process of claim 1 wherein the separation between stages produces three streams, one of which is a $C_9+$ aromatics-rich stream which is collected; a $C_5-$ stream which is also collected; and the remaining fraction which is sent to the second stage reforming.

* * * * *